US007715761B2

(12) United States Patent
Uda et al.

(10) Patent No.: US 7,715,761 B2
(45) Date of Patent: May 11, 2010

(54) IMAGE FORMING UNIT, PROCESS CARTRIDGE, AND IMAGE FORMING APPARATUS

(75) Inventors: Junroh Uda, Kanagawa (JP); Sadayuki Iwai, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 156 days.

(21) Appl. No.: 11/852,572

(22) Filed: Sep. 10, 2007

(65) Prior Publication Data

US 2008/0260438 A1 Oct. 23, 2008

(30) Foreign Application Priority Data

Sep. 19, 2006 (JP) ..... 2006-252606

(51) Int. Cl.

| | |
|---|---|
| ***G03G 15/02*** | (2006.01) |
| ***G03G 21/16*** | (2006.01) |
| ***G03G 15/01*** | (2006.01) |
| ***G03G 21/00*** | (2006.01) |

(52) U.S. Cl. ..... 399/168; 399/111; 399/299; 399/346

(58) Field of Classification Search ..... 399/111, 399/159, 168, 170, 176, 299, 346
See application file for complete search history.

(56) References Cited

U.S. PATENT DOCUMENTS

| | | | | |
|---|---|---|---|---|
| 4,672,505 | A * | 6/1987 | Tsuchiya et al. | 399/170 X |
| 5,068,762 | A * | 11/1991 | Yoshihara | 399/168 X |
| 5,112,709 | A * | 5/1992 | Yamazaki et al. | 399/159 X |
| 5,943,532 | A * | 8/1999 | Ohnuma | 399/299 X |
| 6,295,438 | B1 | 9/2001 | Fujishiro et al. | |
| 6,611,672 | B2 | 8/2003 | Aoki et al. | |
| 7,203,452 | B2 | 4/2007 | Miyawaki et al. | |
| 2007/0003315 | A1 | 1/2007 | Iwai | |
| 2007/0140728 | A1 | 6/2007 | Miyawaki et al. | |

FOREIGN PATENT DOCUMENTS

| | | |
|---|---|---|
| JP | 5-307279 | 11/1993 |
| JP | 2001-51467 | 2/2001 |
| JP | 2002-156806 | 5/2002 |
| JP | 2002-341618 | 11/2002 |
| JP | 2004-61855 | 2/2004 |
| JP | 3587094 | 8/2004 |
| JP | 3795709 | 4/2006 |

OTHER PUBLICATIONS

U.S. Appl. No. 11/406,267, filed Apr. 19, 2006, Naomi Sugimoto, et al.

* cited by examiner

*Primary Examiner*—Sandra L Brase
(74) *Attorney, Agent, or Firm*—Oblon, Spivak, McClelland, Maier & Neustadt, L.L.P.

(57) ABSTRACT

An image forming apparatus includes a plurality of toner-image forming units. Each toner-image forming unit includes a photosensitive drum and a charging unit that is arranged to abut against or remain detached from the photosensitive drum, and that electrically charges the photosensitive drum. Each of the toner-image forming units forms an image of a different color. At least one of the charging units functions as a corona charging unit and at least another one of the charging units functions as a non-contact charging unit.

22 Claims, 8 Drawing Sheets

IMAGE FORMING UNIT, PROCESS CARTRIDGE, AND IMAGE FORMING APPARATUS

CROSS-REFERENCE TO RELATED APPLICATIONS

The present application claims priority to and incorporates by reference the entire contents of Japanese priority document, 2006-252606 filed in Japan on Sep. 19, 2006.

BACKGROUND OF THE INVENTION

1. Field of the Invention

The present invention generally relates to an image forming apparatus, and specifically relates to a charging mechanism for photosensitive drums.

2. Description of the Related Art

A tandem-type full-color electrophotographic image forming apparatus includes a plurality of toner-image forming units. Each toner-image forming unit includes a photosensitive drum on which an electrostatic latent image is formed, and a charging unit that electrically charges the photosensitive drum such that the electrostatic latent image on the photosensitive drum is developed with a single-color toner, such as yellow, cyan, magenta, and black, into a single-color toner image. The charging unit is arranged to abut against or remain detached from the photosensitive drum. To downsize such an image forming apparatus, the charging unit is usually arranged such that a charging roller, a charging brush, or a charging blade in the charging unit abuts against the photosensitive drum or lies adjacent to but detached from the photosensitive drum.

Each of the charging rollers charges a corresponding photosensitive drum either by using direct current (DC) charging or alternate current (AC) superimposition charging. The DC charging has a drawback that sometimes the photosensitive drums are not charged uniformly thereby failing to maintain the image quality. The AC-superimposition charging is advantageous in that the photosensitive drums are always uniformly charged thereby improving the image quality. That is why the AC-superimposition charging is gaining popularity. However, because the amount of discharging in the AC-superimposition charging is more, the surface of the photosensitive drums may get damaged due to the byproducts produced due to the discharge and the image quality may deteriorate.

In recent years, organic photosensitive drums are widely used in the image forming apparatuses. However, the organic photosensitive drums have a low degree of hardness and a weak tensile strength. Thus, they are prone to abrasion wear. Moreover, toner components or paper dust easily gets attached on the surface of such organic photosensitive drums thereby degrading the quality of cleaning or efficiency of image transfer, which results in corrupt images. In an image forming apparatus in which cleaning of the organic photosensitive drums is performed by blades, because of the high friction coefficient of the organic photosensitive drums, noise is generated at the time of cleaning. To solve such problems, a lubricant in liquid form or solid form, which also functions as a surface protectant, is applied on the surface of the organic photosensitive drums.

The lubricant lubricates the surface of the photosensitive drums such that the friction between the cleaning blades and the photosensitive drums is controlled. The lubricant also guards the surface of the photosensitive drums from being damaged due to collision of excited electrons generated during the AC-superimposition charging.

A tandem-type full-color image forming apparatus is disclosed in Japanese Patent No. 3587094 in which a photosensitive drum that forms electrostatic latent images in black is charged by a non-contact charging mechanism, while photosensitive drums that form electrostatic latent images in a color other than black are charged by a contact charging mechanism. In the contact charging mechanism, charging rollers are arranged to abut against the corresponding photosensitive drums.

A tandem-type full-color image forming apparatus is disclosed in Japanese Patent Application Laid-Open Nos. 2002-156806 and 2002-341618 in which photosensitive drums are charged by using charging members that abut against the corresponding photosensitive drums or lie adjacent to but detached from the corresponding photosensitive drums. The photosensitive drum that forms electrostatic latent images in black is charged by the DC charging, while the photosensitive drums that form electrostatic latent images in a color other than black are charged by the AC-superimposition charging.

A tandem-type full-color image forming apparatus is disclosed in Japanese Patent Application Laid-Open No. 2001-034111 in which the amount of lubricant applied on the surface of each photosensitive drum is adjusted as per the requirement. Particularly, more amount of lubricant is applied on the photosensitive drums that lie on the downstream along the direction in which a transfer paper is conveyed.

A tandem-type full-color image forming apparatus is disclosed in Japanese Patent Application Laid-Open No. 2004-061855 in which the amount of lubricant applied on the surface of a photosensitive drum that forms electrostatic latent images in black is more than the amount of lubricant applied on the surface of photosensitive drums that form electrostatic latent images in a color other than black.

In the tandem-type full-color image forming apparatus as disclosed in Japanese Patent No. 3587094, because the photosensitive drums that form electrostatic latent images in a color other than black are charged by the contact charging mechanism, the surface of those photosensitive drums is damaged due to the friction with the charging rollers. As a result, such photosensitive drums have less durability than the photosensitive drums that are charged by a non-contact charging mechanism. Moreover, toner gets attached easily to such a contact charging mechanism thereby reducing its durability. Instead of the contact charging mechanism, if a corona charging mechanism, particularly a scorotron charging mechanism, is used to charge a photosensitive drum, then poison gases such as ozone are produced that need to be properly disposed. Hence, if the scorotron charging mechanism is used to charge all the photosensitive drums, the size of the image forming apparatus becomes large because of the additional components required to exhaust the poison gases.

On the other hand, in the tandem-type full-color image forming apparatus as disclosed in Japanese Patent Application Laid-Open Nos. 2002-156806, 2002-341618, 2001-034111, and 2004-061855, the problem of damaging the surface of the photosensitive drums due to the friction with the charging members is not comprehensively solved. Hence, there is a need of a technology that would uniformly charge the photosensitive drums with minimum damage to their surface.

SUMMARY OF THE INVENTION

It is an object of the present invention to at least partially solve the problems in the conventional technology.

According to an aspect of the present invention, there is provided an electrophotographic image forming mechanism that includes a plurality of toner-image forming units each forming an image of a different color. Each of the toner-image forming units includes a rotatable photosensitive drum; and a charging unit that electrically charges the photosensitive drum. At least one of the charging units functions as a corona charging unit and at least another one of the charging units functions as a non-contact charging unit.

According to another aspect of the present invention, there is provided a process cartridge detachably attachable to an electrophotographic image forming apparatus in plurality. Each of the process cartridges includes a toner-image forming unit that forms an image of a different color. Each of the toner-image forming units includes a rotatable photosensitive drum; and a charging unit that electrically charges the photosensitive drum. At least one of the charging units functions as a corona charging unit and at least another one of the charging units functions as a non-contact charging unit.

According to still another aspect of the present invention, there is provided an image forming apparatus including a plurality of toner-image forming units each forming an image of a different color. Each of the toner-image forming units includes a rotatable photosensitive drum; and a charging unit that electrically charges the photosensitive drum. At least one of the charging units functions as a corona charging unit and at least another one of the charging units functions as a non-contact charging unit.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are described in detail below with reference to the accompanying drawings. The present invention is not limited to these exemplary embodiments.

Figure 1:
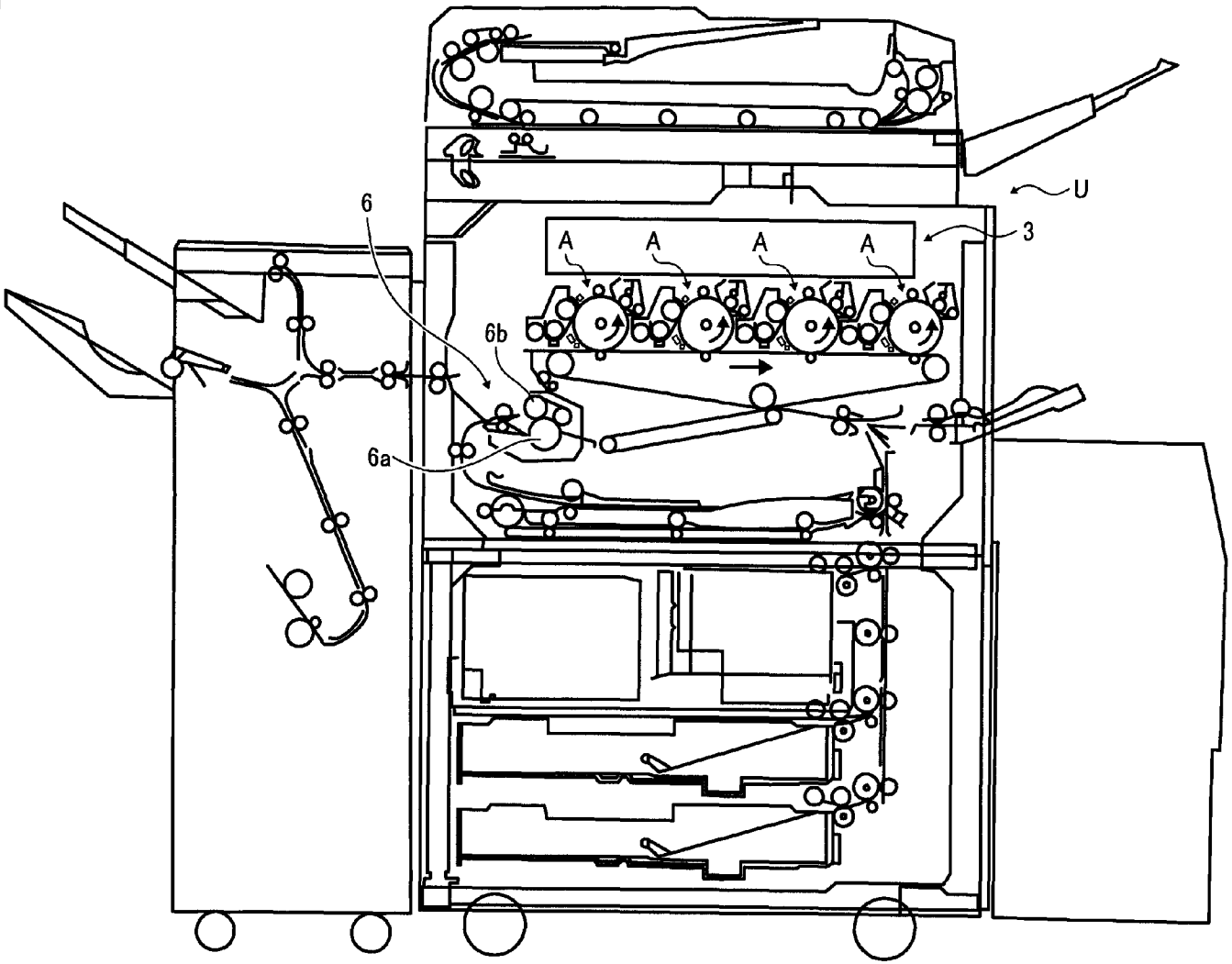
FIG. 1 is a side view of an image forming apparatus according to a first embodiment of the present invention.

FIG. 1 is a side view of a tandem-type full-color image forming apparatus, such as a color copying machine, according to a first embodiment of the present invention. The image forming apparatus includes an electrophotographic image forming mechanism U.

Figure 2:
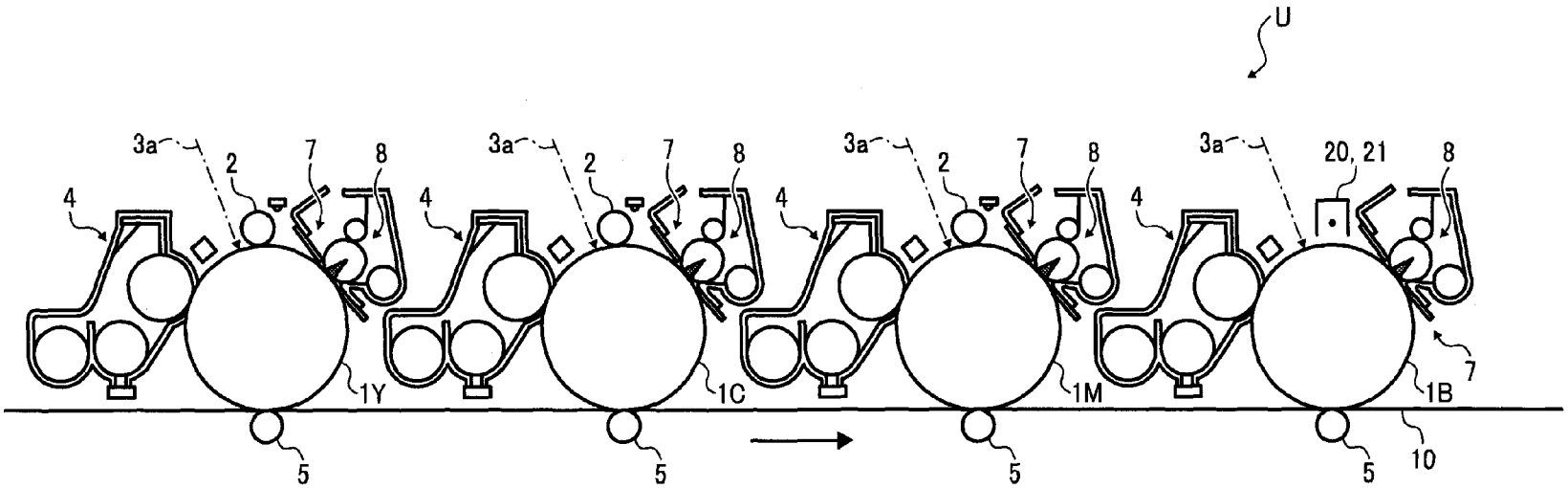
FIG. 2 is a side view of an image forming mechanism in the image forming apparatus shown in FIG. 1.

FIG. 2 is a side view of the image forming mechanism U. The image forming mechanism U includes four toner-image forming units. Each toner-image forming unit forms toner images in a single color each corresponding to yellow, magenta, cyan, or black. A toner-image forming unit corresponding to yellow includes a rotatable photosensitive drum 1Y that forms a single color image in yellow, a toner-image forming unit corresponding to cyan includes a rotatable photosensitive drum 1C that forms a single color image in cyan, a toner-image forming unit corresponding to magenta includes a rotatable photosensitive drum 1M that forms a single color image in magenta, and a toner-image forming unit corresponding to black includes a rotatable photosensitive drum 1B that forms a single color image in black.

Moreover, each toner-image forming unit includes a light exposing unit 3 (see FIG. 1), a toner-image developing unit 4, an intermediate transfer unit 5, a fixing unit 6, and a drum-cleaning unit 7 arranged around the corresponding photosensitive drum 1Y, 1C, 1M, or 1B. The fixing unit 6 is arranged on the downstream of the intermediate transfer unit 5. On the photosensitive drums 1Y, 1C, 1M, and 1B, toner images in the corresponding single color are formed. As shown in FIG. 2, the photosensitive drums 1Y, 1C, 1M, and 1B are sequentially arranged in a line along the direction of movement of an intermediate transfer belt 10.

Figure 3:
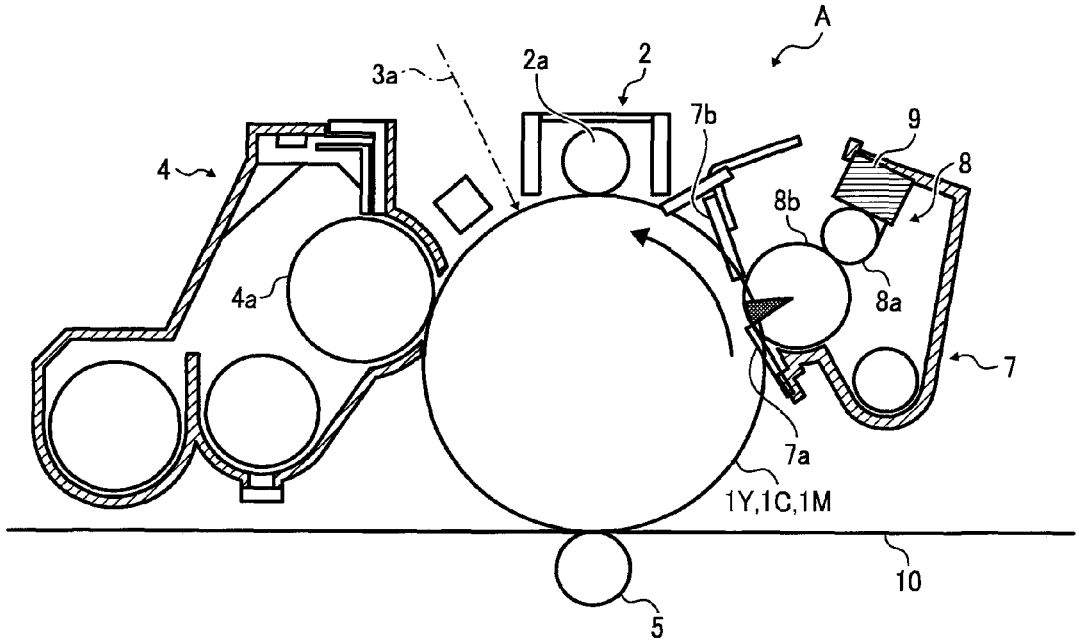
FIG. 3 is an enlarged side view of a toner-image forming unit, which implements a non-contact charging mechanism to charge a photosensitive drum, in the image forming mechanism shown in FIG. 2.
Figure 4:
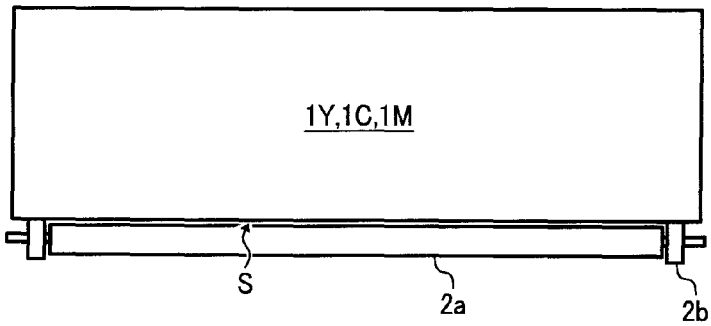
FIG. 4 is an enlarged top view of the toner-image forming unit shown in FIG. 3.
Figure 5:
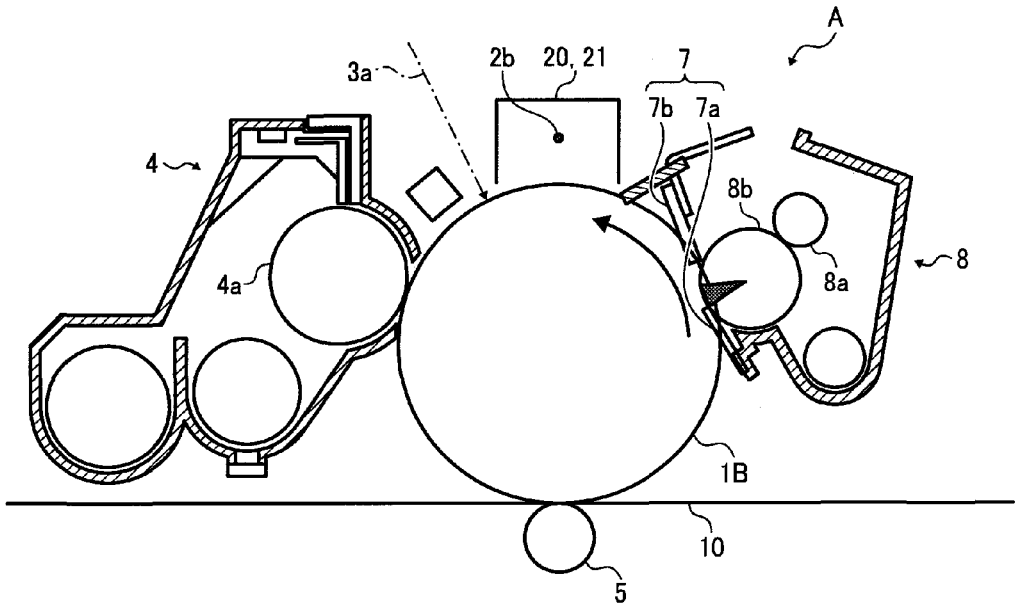
FIG. 5 is an enlarged side view of a toner-image forming unit, which implements a scorotron charging mechanism to charge a photosensitive drum, in the image forming mechanism shown in FIG. 2.
Figure 6:
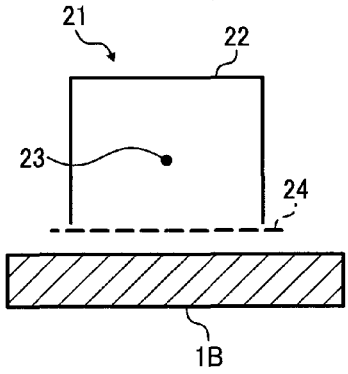
FIG. 6 is an enlarged side view depicting detailed arrangement of the scorotron charging mechanism with respect to the photosensitive drum in the toner-image forming unit shown in FIG. 5.
Figure 7:
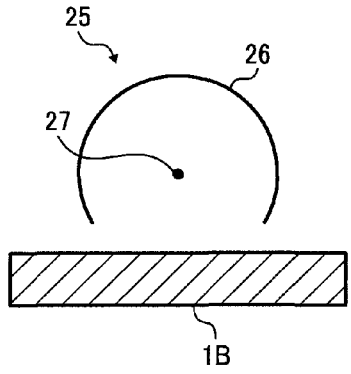
FIG. 7 is an enlarged side view of a corotron charging mechanism, which can be used to charge the photosensitive drum in the toner-image forming unit shown in FIG. 5.

Three of the toner-image forming units, each including one of the photosensitive drums 1Y, 1M, and 1C, include a non-contact charging unit 2, while the remaining toner-image forming unit that, which includes the photosensitive drum 1B, includes a corona charging unit 20. FIG. 3 is an enlarged side view of the toner-image forming unit corresponding to yellow. The toner-image forming unit corresponding to magenta or cyan has the same or similar configuration. In FIG. 3, the non-contact charging unit 2 electrically charges the photosensitive drum 1Y (1C or 1M). FIG. 4 is an enlarged perspective view depicting detailed arrangement of the non-contact charging unit 2. FIG. 5 is an enlarged perspective view of the toner-image forming unit corresponding to black. In FIG. 5, the corona charging unit 20 functions as a scorotron charging mechanism 21, which is a type of a corona charging mechanism, and electrically charges the photosensitive drum 1B. FIG. 6 is an enlarged view depicting detailed arrangement of the scorotron charging mechanism 21 with respect to the photosensitive drum 1B shown in FIG. 5. FIG. 7 is an enlarged perspective view depicting detailed arrangement of the corona charging unit 20 that functions as a corotron charging mechanism 25, which is another type of a corona charging mechanism, with respect to the photosensitive drum 1B shown in FIG. 5.

The photosensitive drums 1Y, 1C, 1M, and 1B, which function as latent image carriers, can be made of photoconductive amorphous metals such as amorphous silicon or amorphous selenium, or organic compounds such as azo pigment or phthalocyanine. It is recommended to use the organic compounds as they are eco-friendly and easy to after-treat. To prevent abrasion wear of the surface of such an organic photosensitive drum, a protective layer is laid on its surface. To enhance the physical strength of the protective layer, a resin having a cross-linked structure is used, or inorganic particulates such as silicon dioxide ($SiO_2$, also known as silica), aluminum oxide (also known as alumina), zinc oxide, or titanium oxide (also known as titania) are mixed in the protective layer in the range of 3 wt % to 70 wt %. As a result, the physical strength of the protective layer enhances whereby it can withstand friction with a cleaning blade.

For the reasons described above, organic photosensitive drums are used as the photosensitive drums 1Y, 1C, 1M, and 1B, and a protective layer of approximately 5 micrometers is laid on the charge-transport layer of each of the photosensitive drums 1Y, 1C, 1M, and 1B. Both the charge-transport layer and the protective layer include a binder resin in the form of polycarbonate, 7 wt % of charge transport material, and 10 wt % of silica powder used for enhancing the physical strength of the charge-transport layer and protective layer.

As described above, the photosensitive drums 1Y, 1C, 1M, and 1B are sequentially and equidistantly arranged in a line along the direction of movement (shown by an arrow mark in FIG. 2) of the intermediate transfer belt 10. In other words, the photosensitive drum 1Y is arranged on the mostupstream, while the photosensitive drum 1B having the highest frequency of usage is arranged on the mostdownstream. The photosensitive drums 1C and 1M are arranged in between the photosensitive drums 1Y and 1B.

It is recommended to implement a corona charging mechanism only to a photosensitive drum that lies on the mostupstream or the mostdownstream. The reason for that is as follows. When the corona charging mechanism is implemented to charge a photosensitive drum, poison gases such as ozone are produced, which need to be properly disposed. For that, it is necessary to blow a stream of air from outside in the proximity of the corona charging mechanism, and then exhaust the air containing poison gases. An air duct is laid to perform that operation. When the corona charging method is implemented to charge the photosensitive drum on the upstream end or the downstream end, it is possible to easily secure sufficient space for the air duct in the vicinity of the photosensitive drum. On the other hand, if the corona charging method is implemented to charge a photosensitive drum that does not lie at the ends, a long air duct becomes necessary for poison gas exhaust thereby resulting in upsizing the image forming apparatus.

To avoid such problems, it is recommended to arrange the photosensitive drum 1B, which is electrically charged by the corona charging unit 20, either on the upstream end or on the downstream end along the direction of movement of the intermediate transfer belt 10. However, it is recommended to arrange the photosensitive drum 1B, along with the corona charging unit 20 that electrically charges the photosensitive drum 1B, on the downstream end along the direction of movement of the intermediate transfer belt 10 as shown in FIG. 2. The reason for that is as follows. The most important factor in an image forming process is the printing speed of a black image. In other words, it is preferable to minimize the time required for a black image to be transferred onto a transfer paper from the photosensitive drum 1B. That can be achieved by arranging the photosensitive drum 1B on the downstream end along the direction of movement of the intermediate transfer belt 10.

Therefore, in the image forming mechanism U, only the photosensitive drum 1B is electrically charged by using the corona charging unit 20. The corona charging unit 20 functions as the scorotron charging mechanism 21, as shown in FIG. 5. On the other hand, the rest of the photosensitive drums 1Y, 1C, and 1M are electrically charged by using the non-contact charging unit 2.

As shown in FIGS. 3 and 4, the non-contact charging unit 2 includes a charging roller 2*a* and a power supply unit (not shown). The outer surface of the cored bar of the charging roller 2*a* has either one or both of an elastic layer and a resin layer. The power supply unit apples a voltage to the charging roller 2*a*. Because of the voltage difference between the charging roller 2*a* and the corresponding photosensitive drum 1Y, discharging occurs in the space S between the charging roller 2*a* and the photosensitive drum 1Y (1C or 1M). As a result, the surface of the photosensitive drum 1Y (1C or 1M) gets uniformly charged.

Usually, when the charging roller is arranged to abut against a photosensitive drum for contact charging, the surface of the charging roller is applied with an elastic layer to achieve stable abutting. The elastic layer can be made of an electrically conductive rubber having a degree of hardness in the range of 30 to 80 according to JIS-A standard or an electrically conductive sponge material having a degree of hardness in the range of 15 to 60 according to asker-C standard. The electrically conductive sponge material can be made of mixing acrylonitrile-butadiene rubber (NBR), chloroprene rubber (CR), ethylene propylene diene monomer (EPDM), or urethane rubber with electrically conductive fillers of carbon or titanium oxide mixed therein. The electrically conductive sponge material can also be made of an ion-conductive epichlorohydrin rubber, or a combination of the epichlorohydrin rubber and the other types of rubber described above.

On the other hand, when using the non-contact charging unit 2, it is necessary to precisely maintain the gap S, as shown in FIG. 4, between the charging roller 2*a* and the photosensitive drum 1Y (1C or 1M). When using the non-contact charging unit 2, the charging roller 2*a* is made of an elastic material having a higher degree of hardness (in the range of 70 to 90 according to JIS-A standard) or a resin material having a superior outer diameter accuracy. Various resin materials can be used as the elastic layer if their electrical conductivity is secured. For example, it is possible to use resin materials such as acrylic urethane, polyethylene resin, polystyrene, acrylonitrile-butadiene styrene polymer (ABS), polycarbonate, or fluorinated resin. A material to control the conducting properties is mixed to the resin material and the volume resistance of the elastic layer is adjusted to be in the range of 6 log Ωcm to 10 log Ωcm. To maintain the gap S between the charging roller 2*a* and the photosensitive drum 1Y (1C or 1M), a gap maintaining mechanism 2*b* is arranged at both ends of the charging roller 2*a* in a portion where an image is not formed on the photosensitive drum 1Y (1C or 1M) on which no image is formed.

The gap maintaining mechanism 2*b* can be a roller or a tape with uniform thickness that can maintain the rolling axis of the charging roller 2*a* at a constant distance from the central axis of the photosensitive drum 1Y (1C or 1M). It is recommended to maintain the gap S in the range of 10 micrometers to 500 micrometers. A smaller gap S enables to reduce the cost related to the voltage applied to the charging roller 2*a*. However, if the gap S is too small, then it becomes necessary to increase the machine accuracy to maintain the gap S. As a result, the assembly of the toner-image forming unit becomes complicated. Moreover, the charging roller 2*a* may gather dirt because of the toner coming into the gap S or foreign material present on the photosensitive drum 1Y (1C or 1M). Hence, it is preferable to maintain the gap S in the range of 30 micrometers to 60 micrometers.

Irrespective of whether a charging toner is arranged to abut against a photosensitive drum, a smooth surface with good releasability prevents the charging toner from catching dirt. Such a surface can be made of a fluorinated material or a silicon material.

Another way to electrically charge a photoconductive drum by a non-contact charging mechanism is to use corona discharging. In such a non-contact charging mechanism, a thin wire of diameter in the range of 50 micrometers to 100 micrometers is arranged on a metal electrode. When a voltage is applied to the metal electrode, discharging phenomenon in violet color occurs in the proximity of the wire until the wire undergoes sparking discharge. This is called corona discharging. The corona discharging has a negative discharging and a positive discharging, which depends on the polarity of the applied voltage. However, in case of negative discharging, there is high possibility of uneven discharging, which badly affects uniform charging of the photosensitive drum.

In the corona charging unit 20 that uses the corona discharging, two types of mechanisms can be implemented. One is a scorotron charging mechanism and the other is a corotron charging mechanism. FIG. 5 is an enlarged side view of the toner-image forming unit corresponding to black. In FIG. 5, the corona charging unit 20 functions as a scorotron charging mechanism 21 to electrically charge the photosensitive drum 1B. FIG. 6 is an enlarged side view depicting detailed arrangement of the scorotron charging mechanism 21 with respect to the photosensitive drum 1B shown in FIG. 5. As shown in FIG. 6, the scorotron charging mechanism 21 includes a rectangular shield 22 that has an opening towards the photosensitive drum 1B, a striated discharging electrode 23 lined inside the shield 22, and a grid electrode 24 that is arranged between the discharging electrode 23 and the photosensitive drum 1B. In FIG. 6, the grid electrode 24 is arranged between the opening of the shield 22 and the photosensitive drum 1B. An intended voltage is applied to the grid electrode 24 such that the photosensitive drum 1B is uniformly charged.

FIG. 7 is an enlarged side view depicting detailed arrangement of the corona charging unit 20, which functions as a corotron charging mechanism 25, with respect to the photosensitive drum 1B shown in FIG. 5. The corotron charging mechanism 25 can be used instead of the scorotron charging mechanism 21. As shown in FIG. 7, the corotron charging mechanism 25 includes a cylindrical shield 26 that has an opening towards the photosensitive drum 1B and a striated discharging electrode 27 lined inside the shield 26. Usually, the corotron charging mechanism 25 is arranged directly on the photosensitive drum 1B. A high voltage of intended polarity is applied to the discharging electrode 27 such that the photosensitive drum 1B is uniformly charged.

Most of the photosensitive drums used at present are negatively charged organic photosensitive drums. Considering the difficulty in uniformly charging the negatively charged photosensitive drums by using negative discharging, a scorotron charging mechanism is usually used instead of a corotron charging mechanism to charge the negatively charged organic photosensitive drums. However, when a corona charging mechanism is implemented to charge a photosensitive drum, poison gases such as ozone are produced, which are hazardous to the environment. Moreover, it is necessary to implement an air-blowing mechanism to exhaust the poison gas. That results in upsizing the image forming apparatus as well as increasing the production cost.

In recent years, most image forming apparatuses are configured to adopt a tandem method for image forming to enhance the efficiency in outputting color images. In tandem-type image forming apparatuses, a plurality of image forming units are sequentially arranged and form a full-color image on a paper that is conveyed to each image forming unit only once. Hence, to downsize a tandem-type image forming apparatus, it is necessary to downsize each image forming unit. To achieve that, tandem-type image forming apparatuses in which a charging mechanism is implemented by using charging rollers are becoming popular because of their compactness. On the other hand, a corona charging mechanism is usually implemented in large image forming apparatuses that require higher processing speed.

However, in a charging mechanism by using charging rollers that abut against a photosensitive drum, the amount of abrasion wear of the photosensitive drum is more thereby reducing its durability. Apart from that, the text used in offices mainly contains characters rather than images. Hence, even if color images are gaining popularity, 80% of the images output in offices contain black and white images according to a survey. Thus, the frequency of usage of an image forming unit that forms black images is very high thereby resulting in frequent replacement of that image forming unit. To reduce the overall maintenance time of the image forming apparatus as well as improve productivity of the user, frequent replacements of the image forming unit should be avoided.

Hence, according to the present embodiment, the scorotron charging mechanism 21, which is a type of non-contact corona charging mechanism, is implemented to charge only the photosensitive drum 1B having the highest frequency of usage. As a result, it is possible to avoid the frequent replacements of the photosensitive drum 1B. On the other hand, the non-contact charging unit 2, which functions as a non-contact charging mechanism by using the charging roller 2*a*, is implemented to charge the rest of the photosensitive drums 1Y, 1C, and 1M. As a result, the image forming apparatus is downsized. Moreover, because the photosensitive drums 1Y, 1C, and 1M do not come into contact with the non-contact charging unit 2, their deterioration due to the abrasion wear is prevented and durability is improved. In other words, as shown in FIG. 3, the image forming mechanism U can be configured such that the corona charging unit 20 (scorotron charging mechanism 21) is used to charge at least the photosensitive drum 1B, while the non-contact charging unit 2 is used to charge at least one of the photosensitive drums 1Y, 1C, and 1M.

The non-contact charging unit 2 charges the photosensitive drums 1Y, 1C, and 1M by using alternate current (AC) superimposition charging instead of direct current (DC) charging. As a result, the image quality does not deteriorate and the durability of the non-contact charging unit 2 improves. In such AC-superimposition charging, when the photosensitive drums 1Y, 1C, and 1M rotate under the corresponding non-contact charging unit 2, discharging occurs for several times thereby uniformly charging the photosensitive drums 1Y, 1C, and 1M. Another merit is that a small amount of dirt on the surface of the photosensitive drums 1Y, 1C, and 1M does not have any effect on the image forming.

On the other hand, because the discharging occurs several times, the surface of the photosensitive drums 1Y, 1C, and 1M is subjected to electrostatic damage. Even in case of the scorotron charging mechanism 21, the surface of the photosensitive drum 1B gets damaged due to the corona discharging. However, the damage to the surface of the photosensitive drum 1B is less than that in case of the photosensitive drums 1Y, 1C, and 1M because the amount of discharging in the scorotron charging mechanism 21 is less than that in the non-contact charging unit 2.

Figure 10:
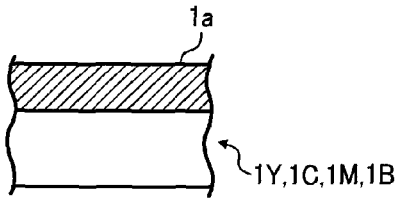
FIG. 10 is an enlarged side view of a portion of the photosensitive drum shown in FIG. 3.

To avoid such damage, it is necessary to apply a surface protectant 1*a* on the surface of the photosensitive drums 1Y, 1C, 1M, and 1B (see FIG. 10). The amount of the surface protectant 1*a* can be adjusted corresponding to each photosensitive drum 1Y, 1C, 1M, and 1B such that there is no wastage of the surface protectant 1*a*.

Figure 11:
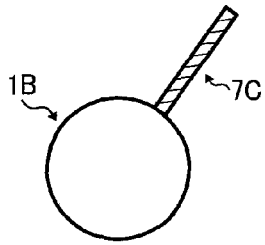
FIG. 11 is a side view of the photosensitive drum shown in FIG. 5 to which a polishing blade is arranged for polishing.

For example, because the surface of the photosensitive drum 1B gets less damaged than the surfaces of the photosensitive drums 1Y, 1C and 1M, the amount of the surface protectant 1*a* required for the photosensitive drum 1B is much less than that required for the other photosensitive drums 1Y, 1C, and 1M. A configuration is allowable in which the surface protectant 1*a* is not applied to the photosensitive drum 1B. Instead, a polishing blade 7*c*, as shown in FIG. 11, is arranged to scrape out foreign materials that get attached to the surface of the photosensitive drum 1B. As a result, uneven charging of the photosensitive drum 1B is prevented without any wastage of the surface protectant 1*a*.

On the other hand, because the surface protectant 1*a* is applied directly on the surface of the photosensitive drums 1Y, 1C, and 1M, it is difficult for any foreign material to come in direct contact with the surface itself.

If the surface protectant 1*a* is excessively applied, due to friction with a first cleaning blade 7*a* of the drum-cleaning unit 7, a thin film of chemical compounds of the surface protectant or external additives of toner is formed on the surface of the photosensitive drums 1Y, 1C, and 1M. The portion on which such a thin film is formed is not charged sufficiently thereby resulting in a corrupt image.

The light exposing unit 3 (see FIG. 1) receives data from a scanning device or image signals from an outside component such as a personal computer (not shown). The light exposing unit 3 then performs transformation of the image signals, scans the image signals with a laser light 3*a* by using a polygon motor, and based on the image signals that pass the polygon mirror forms latent images on the photosensitive drums 1Y, 1C, 1M, and 1B.

As shown in FIG. 2, the toner-image developing unit 4 includes a hollow and cylindrical developer carrier 4*a* (see FIG. 3) that carries the developer and supplies it to the photosensitive drum 1Y (1C, 1M, and 1B), a developer-amount controlling unit that controls the amount of developer carried by the developer carrier 4*a*, and a toner feeding chamber. The developer carrier 4*a* is pivotably supported around an inside shaft to which a magnet-roll is also fixed.

The developer carrier 4*a* is arranged to keep a small distance from the photosensitive drum 1Y (1C, 1M, or 1B). A predetermined amount of developer is magnetically adsorbed to the outer surface of the developer carrier 4*a* and then supplied to the photosensitive drum 1Y (1C, 1M, or 1B). The developer carrier 4*a* is made of an electrically conductive and nonmagnetic material. A power supply unit applies a developing bias to the developer carrier 4*a*. The power supply unit applies voltage in between the developer carrier 4*a* and the photosensitive drum 1Y (1C, 1M, or 1B) such that an electric field is generated in the developing area.

The intermediate transfer unit 5 is arranged corresponding to each photosensitive drum 1Y, 1C, 1M, and 1B on the inner side of the intermediate transfer belt 10, as shown in FIG. 2.

The fixing unit 6 (see FIG. 1) includes a fixing roller 6*a* and a pressurized roller 6*b*. The fixing roller 6*a* performs heat fixing by using a heater made of, e.g., halogen lamp. The pressurized roller 6*b* is crimped by the fixing roller 6*a*. The surface of the cored bar of the fixing roller 6*a* is covered by an elastic layer of, e.g., silicon rubber. The thickness of the elastic layer is kept in the range of 100 micrometers to 500 micrometers although it is recommended to keep a thickness of 400 micrometers. To prevent sticking of the toner on the fixing roller 6*a*, the fixing roller 6*a* is covered by a resin layer with good releasability such as a fluorinated resin layer. The resin layer is made of a tetrafluoroethylene-perfluoroalkyl vinyl ether (PFA) tube and it is recommended to keep its thickness in the range of 10 micrometers to 50 micrometers to minimize the mechanical deterioration. A temperature detecting unit is arranged at the outer surface of the fixing roller 6*a*. The heater is regulated to maintain a substantially uniform surface temperature in the range of 160° C. to 200° C. The surface of the cored bar of the pressurized roller 6*b* is covered by an offset preventing layer made of tetrafluoroethylene-perfluoroalkyl vinyl ether (PFA) or polytetrafluoroethylene (PTFE). Similar to the fixing roller 6*a*, an elastic layer of silicon rubber can also be used to cover the cored bar of the pressurized roller 6*b*.

Instead of the fixing unit 6 including the fixing roller 6*a* or the pressurized roller 6*b* in cylindrical shape, a belt fixing unit can be used in which rollers are belt-shaped. Instead of applying the heat fixing method by using the halogen lamp, an induction heat fixing method can be applied in which heat is generated by the eddy current produced by an outside magnetic force.

The drum-cleaning unit 7 (see FIGS. 3 and 5) includes the first cleaning blade 7*a*, a second cleaning blade 7*b*, a waste-toner scooping blade (not shown) that scoops the waste toner after cleaning, a waste-toner carrying coil (not shown), and a waste-toner box (not shown) to which the waste toner is carried by the waste-toner carrying coil. The first cleaning blade 7*a* and the second cleaning blade 7*b* are sequentially arranged along the direction of movement of the photosensitive drum 1Y (1C or 1M) or 1B such that the first cleaning blade 7*a* cleans the photosensitive drum 1Y (1C or 1M) or 1B before the second cleaning blade 7*b* cleans the same.

The first cleaning blade 7*a* can be made of metal, resin, or rubber. For example, various types of materials such as fluorinated resin, silicon rubber, butyl rubber, butadiene rubber, isoprene rubber, and polyurethane rubber are widely used for making the first cleaning blade 7*a* among which it is particularly recommended to use polyurethane rubber. The first cleaning blade 7*a* mainly scrapes out the residual toner on the photosensitive drum 1Y (1C or 1M) or 1B after the image transfer is complete.

The second cleaning blade 7*b* scrapes out the foreign material from the filming formed due to toner additives on the photosensitive drum 1Y (1C or 1M) or 1B. The second cleaning blade 7*b* can be made from the material same as that of the first cleaning blade 7*a*. However, to scrape out the foreign material more effectively, it is recommended to use an abrasive blade that is made of an elastic material with granules of an abrasive agent.

The drum-cleaning unit 7 also includes a lubricant coating mechanism 8 that is arranged between the first cleaning blade 7*a* and the second cleaning blade 7*b*. The lubricant coating mechanism 8 includes a lubricant 9 in solid form, a lubricant scraping member 8*a* that scrapes the lubricant 9, and a brush roller 8*b* that coats the surface of the photosensitive drum 1Y (1C or 1M) or 1B with the powder of the lubricant 9 scraped by the lubricant scraping member 8*a*. Actually, a lubricant can be in solid form or liquid form. However, the lubricant 9 is used in solid form considering the coating efficiency, convenience of portability, and prevention of leakage at the time of maintenance.

It is not necessary to use two cleaning blades as described above. Depending on the requirements, the drum-cleaning unit can be configured to include one or more cleaning blades.

The lubricant coating mechanism 8 also functions as a residual-toner collecting mechanism. After the toner image is primary-transferred, the residual toner on the photosensitive drum 1Y (1C or 1M) or 1B is collected at the corresponding lubricant coating mechanism 8. The surface of the photosensitive drum 1Y (1C or 1M) or 1B is then coated with the powder of the lubricant 9. Finally, the first cleaning blade 7*a* scrapes out the still residual toner or filming of the toner additives from the surface of the photosensitive drum 1Y (1C or 1M) or 1B.

The fur of the brush roller 8*b* is made by adding to resin material such as nylon or acrylic a resistant material such as carbon black, and adjusting the volume resistance of that mixture in the range of 3 log Ωcm to 61 log Ωcm. The brush roller 8*b* is kept connected to the lubricant 9 via the lubricant scraping member 8*a* by using the urging force of a spring. The lubricant 9 can be made of a metallic soap of lead oleate, zinc oleate, copper oleate, zinc stearate, cobalt stearate, iron stearate, copper stearate, zinc palmitate, copper palmitate, or lead linolenate. These metallic soaps are saturated resin compounds having lamellar atomic structure and excellent lubricating effect. In particular, zinc stearate is recommended because it has excellent and proven durability as well as lubricating property. The lubricant 9 can be used in the form of a lubricant compact by rubbing the powder of zinc stearate or calcium stearate on a solid compact.

When the brush roller 8*b* rotates, the minute particles of the lubricant 9 scraped by the lubricant scraping member 8*a* are deposited on the surface of the photosensitive drum 1Y (1C or 1M) or 1B. After that, due to the contact between the first cleaning blade and the surface of the photosensitive drum 1Y (1C or 1M) or 1B, the minute particles of the lubricant 9 are milled to form a thin film over the photosensitive drum 1Y (1C or 1M) or 1B. As a result, the friction coefficient of the surface of the photosensitive drum 1Y (1C or 1M) or 1B is reduced. At the point where the brush roller 8*b* abuts against the photosensitive drum 1Y (1C or 1M) or 1B, both rotate in the same direction. As a different configuration, the photosensitive drums 1Y, 1C, 1M, and 1B can be coated directly with the powder of zinc stearate or calcium stearate by using a powder coating mechanism.

Figure 8:
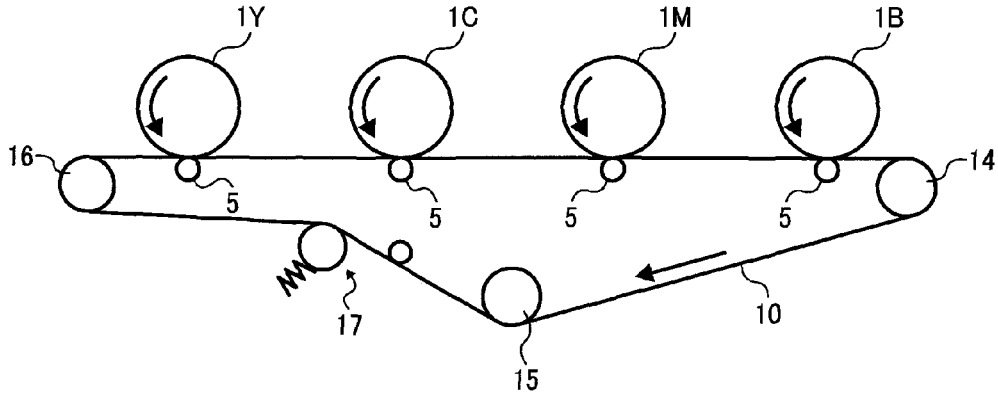
FIG. 8 is a side view of an intermediate transfer belt in the image forming mechanism shown in FIG. 2.
Figure 9:
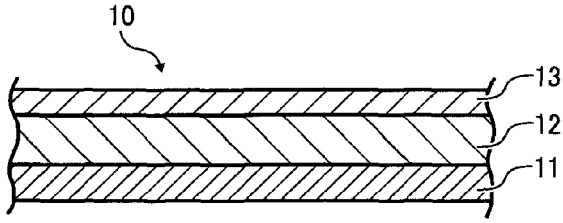
FIG. 9 is a cross-section of the intermediate transfer belt shown in FIG. 8.

FIG. 8 is a side view of the arrangement of the photosensitive drums 1Y, 1C, 1M, and 1B and the intermediate transfer belt 10. FIG. 9 is a cross-section of the intermediate transfer belt 10. As shown in FIG. 9, the intermediate transfer belt 10 includes a base layer 11, an elastic layer 12 that lies on the base layer 11, and a smooth coat layer 13 that covers the elastic layer 12. The base layer 11 is a made of a not-very-elastic fluorinated resin or an elastic rubber material mixed with a not-very-elastic canvas. The elastic layer 12 is made of, e.g., acrylonitrile-butadiene rubber. The coat layer 13 is a layer of, e.g., fluorinated resin that is coated on the elastic layer 12.

As shown in FIG. 8, the intermediate transfer belt 10 is rotatable in the clockwise direction and is stretched around a first supporting roller 14, a second supporting roller 15, and a third supporting roller 16. An intermediate-transfer-belt cleaning unit 17 is arranged between the second supporting roller 15 and the third supporting roller 16. The intermediate-transfer-belt cleaning unit 17 removes the residual toner on the intermediate transfer belt 10 after the process of image transfer is complete. The photosensitive drums 1Y, 1C, 1M, and 1B are sequentially arranged in a line between the third supporting roller 16 and the first supporting roller 14 along the direction of movement of the intermediate transfer belt 10.

Instead of the intermediate transfer mechanism using the intermediate transfer belt 10, a direct transfer mechanism can be used in which a conveyer belt conveys a transfer paper such that a toner image on each of the photosensitive drums 1Y, 1C, 1M, and 1B is directly transferred onto the transfer paper to form a full-color image.

Figure 12:
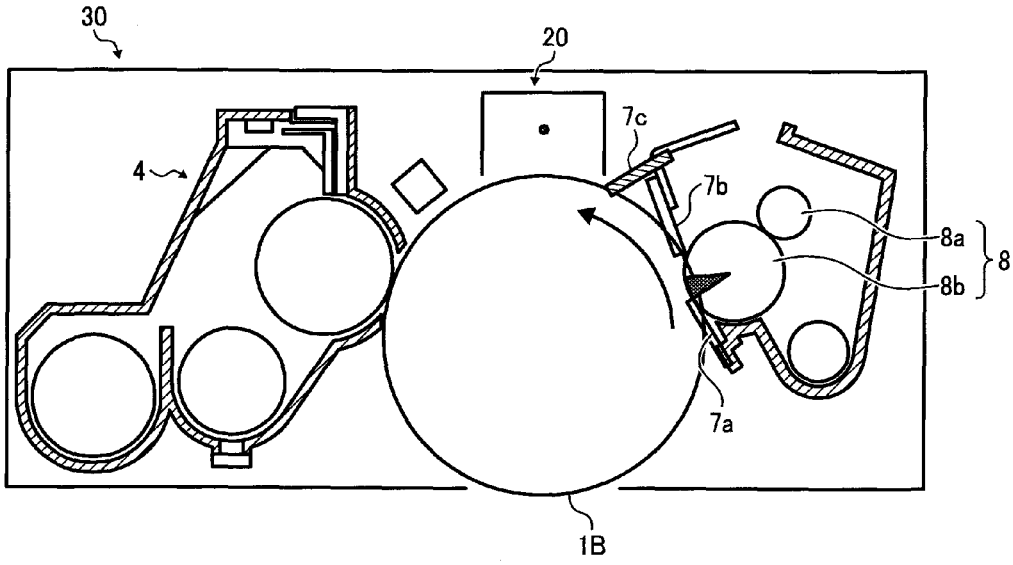
FIG. 12 is a side view of a process cartridge of the image forming mechanism shown in FIG. 2.

FIG. 12 is a side view of a process cartridge 30 that can be detachably attached to the image forming apparatus. The process cartridge 30 can be configured by unitizing some of the components of the toner-image forming unit. Thus, corresponding to four toner-image forming units, four process cartridges 30 are configured. Each process cartridge 30 includes one of the photosensitive drums 1Y, 1C, 1M, and 1B, the corresponding charging unit, viz., the non-contact charging unit 2 or the corona charging unit 20, and any one or both of the corresponding toner-image developing unit 4 and the drum-cleaning unit 7. Because the process cartridges 30 are detachable from the image forming apparatus, replacing them in case of malfunctioning is not difficult. However, even if only one of the components in one of the process cartridge 30 malfunctions, the whole unit of that process cartridge 30 needs to be replaced irrespective of the functional condition of the remaining components. Therefore, maintaining the durability of the components in each process cartridge 30 and achieving low cost for the total unit is important. That object can be achieved by implementing separate charging units, viz., the non-contact charging unit 2 and the corona charging unit 20 depending on the photosensitive drums 1Y, 1C, 1M, and 1B in each process cartridge 30. That helps in improving the durability of the charging roller 2*a* that in turn improves the durability of the process cartridges 30.

Given below is the description of four experiments performed to verify the contents of the image forming apparatus according to the first embodiment.

Figure 13:
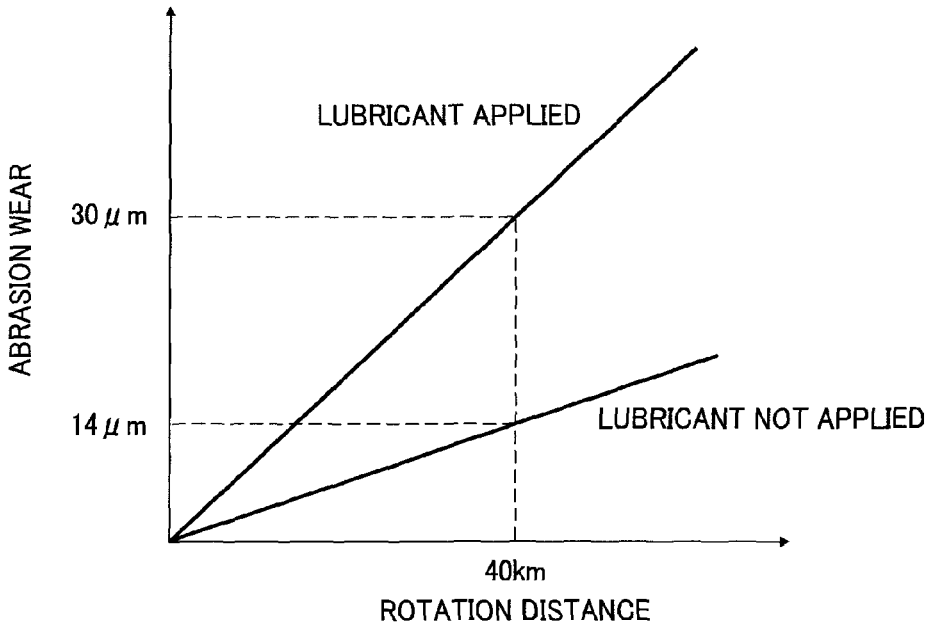
FIG. 13 is a graph depicting the result of a first experiment based on the first embodiment.

The first experiment was performed to verify the difference in the amount of abrasion wear of the first cleaning blade 7*a* under two conditions. Under the first condition, the lubricant 9 was applied on the surface of the corresponding photosensitive drum 1Y, 1C, or 1M. Under the second condition, the lubricant 9 was not applied. The image forming apparatus was set to print 150,000 papers of A4 size under both conditions and the corresponding maximum depth of abrasion wear of the first cleaning blade 7*a* was measured. The lubricant 9 was deposited on a spindle and pressure was applied to the spindle to adjust the amount of the lubricant 9 to be applied. The depth of abrasion wear of the first cleaning blade 7*a* was measured when the distance traveled by the photosensitive drum 1Y, 1C, or 1M under each condition reached 40 kilometers. FIG. 13 is a graph depicting the result of the first experiment. When the lubricant 9 was applied on the surface of the photosensitive drum 1Y, 1C, or 1M, the depth of abrasion wear of the first cleaning blade 7*a* was approximately 30 micrometers. On the other hand, when the lubricant 9 was not applied on the surface of the photosensitive drum 1Y, 1C, or 1M, the depth of abrasion wear of the first cleaning blade 7*a* was approximately 14 micrometers. Thus, the depth of abrasion wear of the first cleaning blade 7*a* when the lubricant 9 was applied on the surface of the photosensitive drum 1Y, 1C, or 1M was more than double when the lubricant 9 was not applied.

Figure 14:
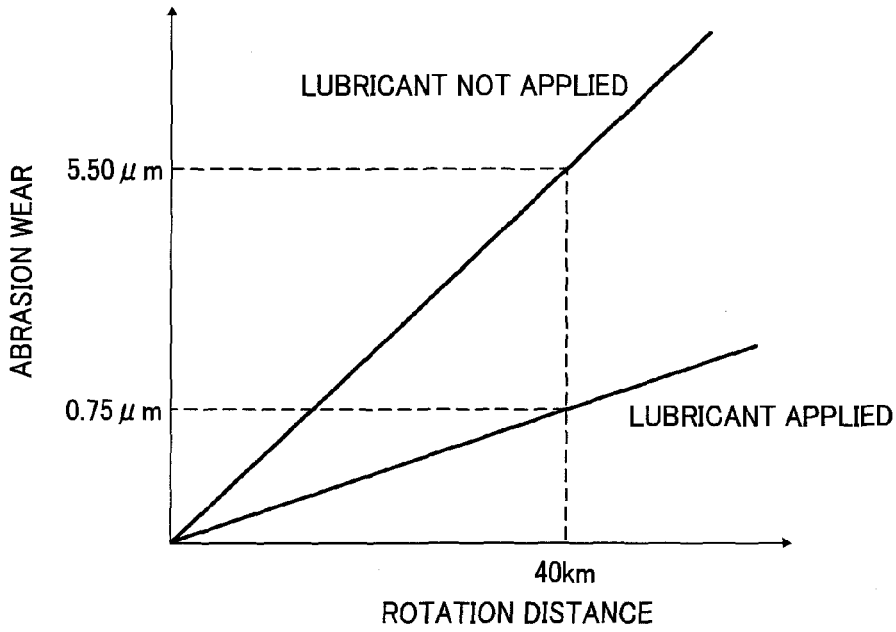
FIG. 14 is a graph depicting the result of a second experiment based on the first embodiment.

The second experiment was performed to verify the difference in the amount of abrasion wear of the photosensitive drums 1Y, 1C, and 1M, which were charged by the non-contact charging unit 2, under two conditions. Under the first condition, the lubricant 9 was applied on the surface of the photosensitive drums 1Y, 1C, and 1M. Under the second condition, the lubricant 9 was not applied. The image forming apparatus was set to print 150,000 papers of A4 size under both conditions and the corresponding maximum depth of abrasion wear of the photosensitive drums 1Y, 1C, and 1M was measured. The depth of abrasion wear was measured when the distance traveled by the photosensitive drums 1Y, 1C, and 1M under each condition reached 40 kilometers. FIG. 14 is a graph depicting the result of the second experiment. When the lubricant 9 was applied, the depth of abrasion wear of the photosensitive drums 1Y, 1C, and 1M was approximately 0.75 micrometers. On the other hand, when the lubricant 9 was not applied, the depth of abrasion wear of the photosensitive drums 1Y, 1C, and 1M was approximately 5.5 micrometers. Thus, the depth of abrasion wear of the photosensitive drums 1Y, 1C, and 1M with the lubricant 9 was more than seven times when the lubricant 9 was not applied. Hence, it is recommended to apply the lubricant 9 on the surface of the photosensitive drums 1Y, 1C, and 1M.

Figure 15:
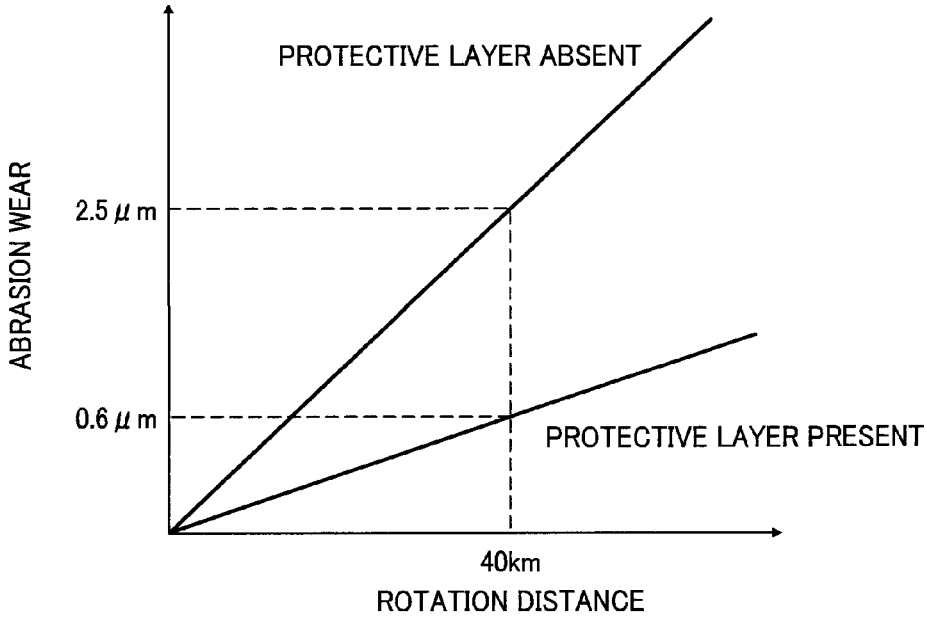
FIG. 15 is a graph depicting the result of a third experiment based on the first embodiment.

The third experiment was performed to verify the effect of the protective layer laid on the photosensitive drum 1B, which was charged by the corona charging unit 20. In the third experiment, the lubricant 9 was not applied on the surface of the photosensitive drum 1B. The experiment was performed under two conditions. Under the first condition, the protective layer was laid on the surface of the photosensitive drum 1B. Under the second condition, the surface of the photosensitive drum 1B was without the protective layer. The image forming apparatus was set to print 150,000 papers of A4 size under both conditions and the corresponding maximum depth of abrasion wear of photosensitive drum 1B was measured when the distance traveled by the photosensitive drum 1B under each condition reached 40 kilometers. FIG. 15 is a graph depicting the result of the third experiment. When the protective layer was present, the depth of abrasion wear of the photosensitive drum 1B was approximately 0.6 micrometers. On the other hand, when the protective layer was absent, the depth of abrasion wear of the photosensitive drum 1B was approximately 2.5 micrometers. Hence, it is recommended to lay the protective layer on the surface of the photosensitive drum 1B.

Figure 16:
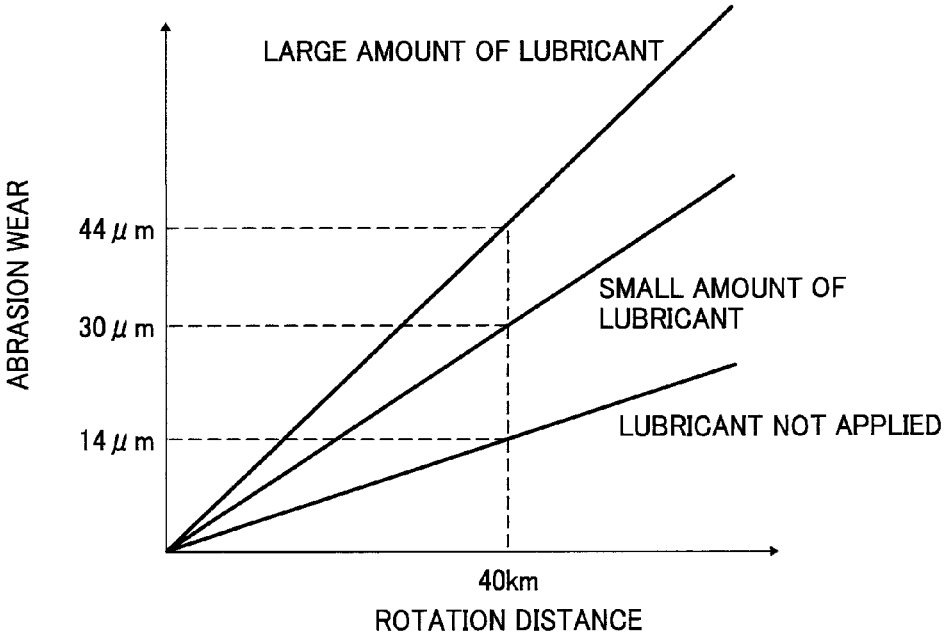
FIG. 16 is a graph depicting the result of a fourth experiment based on the first embodiment.

The fourth experiment was performed to verify the effect on the first cleaning blade 7*a* when the lubricant 9 was applied on the surface of the photosensitive drum 1B, which was charged by the corona charging unit 20. The image forming apparatus was set to print 150,000 papers of A4 size under three conditions and the corresponding maximum depth of abrasion wear of the first cleaning blade 7*a* was measured. Under the first condition, the lubricant 9 was not applied on the surface of the photosensitive drum 1B. Under the second condition, only one spindle was used for applying the lubricant 9. Under the second condition, a small amount of lubricant 9 was applied on the surface of the photosensitive drum 1B by using one spindle. Under the third condition, a large amount of lubricant 9 was applied on the surface of the photosensitive drum 1B by using two spindles. The depth of abrasion wear of the first cleaning blade 7*a* was measured when the distance traveled by the photosensitive drum 1B reached 40 kilometers. FIG. 16 is a graph depicting the result of the fourth experiment. When the lubricant 9 was not applied on the surface of the photosensitive drum 1B, the depth of abrasion wear of the first cleaning blade 7*a* was approximately 14 micrometers. When only one spindle was used, the depth of abrasion wear of the first cleaning blade 7*a* was approximately 30 micrometers. When two spindles were used, the depth of abrasion wear of the first cleaning blade 7*a* was approximately 44 micrometers. Thus, the depth of abrasion wear of the first cleaning blade 7*a* was directly proportional to the amount of the lubricant 9 applied on the surface of the photosensitive drum 1B.

According to an embodiment of the present invention, an image forming apparatus includes a plurality of toner-image forming units. Each toner-image forming unit includes a rotatable photosensitive drum and a charging unit that electrically charges the corresponding photosensitive drum. At least one of the charging units functions as a corona charging mechanism and at least another one of the charging units functions as a non-contact charging mechanism. When the corona charging mechanism is implemented to charge only one photosensitive drum that forms electrostatic latent images in black and has a high frequency of usage, it is possible to avoid frequent replacement of the toner-image forming unit that includes the photosensitive drum for forming black images. On the other hand, when the non-contact charging mechanism is implemented to charge the photosensitive drums that form electrostatic latent images in colors other than black, the image forming apparatus is downsized to a compact size. Moreover, because the photosensitive drums do not come into contact with the corresponding charging rollers, damage due to the abrasion wear is prevented and durability is improved. Thus, by implementing two different charging mechanisms, viz., the corona charging mechanism and the non-contact charging mechanism depending on the corresponding photosensitive drums, enhanced charging performance can be achieved.

The surface of the photosensitive drums that are charged by the non-contact charging mechanism is coated with a lubricant in solid form, which also functions as a surface protectant. On the other hand, the surface of the photosensitive drum that is charged by the corona charging mechanism is not coated with the lubricant. As a result, it is possible to reduce the amount of abrasion wear of the photosensitive drum that forms black images and has a high frequency of usage, and a cleaning blade corresponding to that photosensitive drum.

Furthermore, a protective layer including an inorganic filler is laid on the surface of all the photosensitive drums. That helps in reducing the amount of abrasion wear of the photosensitive drums due to the friction with the blades. Moreover, the non-contact charging mechanism is implemented to charge the photosensitive drums that form images in color other than black by using alternate current (AC) superimposition charging. That helps in performing stable and uniform charging of the photosensitive drums. Furthermore, each photosensitive drum and a developer corresponding to that photosensitive drum are unitized to form a process cartridge that is detachable from the image forming apparatus. As a result, maintenance of the image forming apparatus becomes simple thereby reducing the users work. Moreover, a polishing mechanism is arranged to remove foreign materials attached on the surface of the photosensitive drums. Thus, the toner additives are removed and deterioration of the image quality is prevented.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An electrophotographic image forming mechanism comprising a plurality of toner-image forming units, each of the toner-image forming units forming an image of a different color, each of the toner-image forming units including a rotatable photosensitive drum; and a charging unit that electrically charges the photosensitive drum, wherein at least one of the charging units is a corona charging unit, and at least another one of the charging units is not a corona charging unit and functions as a non-contact charging unit.

2. The image forming mechanism according to claim 1, wherein a superimposed voltage in which a direct current component and an alternate current component are superimposed is applied to the said another one of the charging units.

3. The image forming mechanism according to claim 1, wherein each of the toner-image forming units further includes a coating unit that applies a surface protectant on a surface of the photosensitive drum, and the image forming mechanism further comprises a coating control unit that controls the coating units such that each of the coating unit applies a different amount of the surface protectant on the corresponding photosensitive drum.

4. The image forming mechanism according to claim 3, wherein the coating control unit controls the coating units such that the coating unit corresponding to the photosensitive drum that is charged by the corona charging unit applies less amount of the surface protectant than the coating unit corresponding to the photosensitive drum that is charged by the said another one of the charging units.

5. The image forming mechanism according to claim 3, wherein the coating control unit controls the coating units such that the coating unit corresponding to the photosensitive drum that is charged by the said another one of the charging units applies the surface protectant, and the coating unit corresponding to the photosensitive drum that is charged by the corona charging unit does not apply the surface protectant.

6. The image forming mechanism according to claim 3, wherein the surface protectant is a lubricant in solid form.

7. The image forming mechanism according to claim 1, wherein at least the photosensitive drum that is charged by the corona charging unit includes a protective layer on a periphery of the photosensitive drum.

8. The image forming mechanism according to claim 1, wherein the corona charging unit charges a photosensitive drum having highest frequency of usage from among the photosensitive drums.

9. The image forming mechanism according to claim 8, wherein the photosensitive drum having the highest frequency of usage corresponds to black color.

10. The image forming mechanism according to claim 1, wherein the photosensitive drums are arranged in line along a direction in which a transfer paper is conveyed such that the photosensitive drum that is charged by the corona charging unit is located furthest downstream in the direction of transfer paper conveyance.

11. The image forming mechanism according to claim 1, wherein the toner-image forming unit corresponding to the photosensitive drum that is charged by the corona charging unit further includes a polishing mechanism that removes foreign materials attached on the surface of the photosensitive drum.

12. The electrophotographic image forming mechanism according to claim 1, wherein the said another one of the charging units includes a charging roller that does not contact the photosensitive drum.

13. A process cartridge detachably attachable to an electrophotographic image forming apparatus in plurality, each of the process cartridges comprising a toner-image forming unit that forms an image of a different color, each of the toner-image forming units including a rotatable photosensitive drum; and a charging unit that electrically charges the photosensitive drum, wherein at least one of the charging units is a corona charging unit, and at least another one of the charging units is not a corona charging unit and functions as a non-contact charging unit.

14. The process cartridge according to claim 13, wherein a superimposed voltage in which a direct current component and an alternate current component are superimposed is applied to the said another one of the charging units.

15. The process cartridge according to claim 13, wherein the corona charging unit charges a photosensitive drum having highest frequency of usage from among the photosensitive drums.

16. The process cartridge according to claim 13, wherein the photosensitive drums are arranged in line along a direction in which a transfer paper is conveyed such that the photosensitive drum that is charged by the corona charging unit is located furthest downstream in the direction of transfer paper conveyance.

17. The process cartridge according to claim 13, wherein the said another one of the charging units includes a charging roller that does not contact the photosensitive drum.

18. An image forming apparatus comprising a plurality of toner-image forming units, each of the toner-image forming units forming an image of a different color, each of the toner-image forming units including a rotatable photosensitive drum; and a charging unit that electrically charges the photosensitive drum, wherein at least one of the charging units is a corona charging unit, and at least another one of the charging units is not a corona charging unit and functions as a non-contact charging unit.

19. The image forming apparatus according to claim 18, wherein a superimposed voltage in which a direct current component and an alternate current component are superimposed is applied to the said another one of the charging units.

20. The image forming apparatus according to claim 18, wherein the corona charging unit charges a photosensitive drum having highest frequency of usage from among the photosensitive drums.

21. The image forming apparatus according to claim 18, wherein the photosensitive drums are arranged in line along a direction in which a transfer paper is conveyed such that the photosensitive drum that is charged by the corona charging unit is located furthest downstream in the direction of transfer paper conveyance.

22. The image forming apparatus according to claim 18, wherein the said another one of the charging units includes a charging roller that does not contact the photosensitive drum.

* * * * *